US007362290B2

(12) United States Patent
Aoki

(10) Patent No.: US 7,362,290 B2
(45) Date of Patent: Apr. 22, 2008

(54) IMAGE SIGNAL CORRECTING CIRCUIT, IMAGE PROCESSING METHOD, ELECTRO-OPTICAL DEVICE AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 660 days.

(21) Appl. No.: 10/950,389

(22) Filed: Sep. 28, 2004

(65) Prior Publication Data

US 2005/0104829 A1 May 19, 2005

(30) Foreign Application Priority Data

Oct. 29, 2003 (JP) ..... 2003-369052
Aug. 23, 2004 (JP) ..... 2004-242233

(51) Int. Cl.
*G09G 3/36* (2006.01)

(52) U.S. Cl. ..... 345/77; 345/84; 345/87; 345/89; 345/90; 345/690; 315/169.1; 315/169.2; 315/169.3

(58) Field of Classification Search ..... 345/77, 345/78, 87–100, 102, 204, 690
See application file for complete search history.

(56) References Cited

U.S. PATENT DOCUMENTS 5,289,282 A * 2/1994 Tsuji et al. ..... 348/624
5,579,458 A 11/1996 Yokosuka et al.
6,894,666 B2 * 5/2005 Otawara et al. ..... 345/77
7,113,227 B1 * 9/2006 Kakuya et al. ..... 348/678

FOREIGN PATENT DOCUMENTS

| | | |
|---|---|---|
| JP | A-4-177390 | 6/1992 |
| JP | A-11-102172 | 4/1999 |
| JP | A-11-295697 | 10/1999 |
| JP | A-2002-116735 | 4/2002 |

* cited by examiner

*Primary Examiner*—Richard Hjerpe
*Assistant Examiner*—Jennifer T Nguyen
(74) *Attorney, Agent, or Firm*—Oliff & Berridge, PLC

(57) ABSTRACT

To provide a circuit for preventing degradation of a display quality caused by horizontal crosstalk. An image signal correcting circuit supplies a corrected image signal to a display panel to apply the image signal using the corresponding data line after pre-charging each data line to the predetermined voltage, for a pixel electrode located at the selected scanning line. The image signal correcting circuit comprises a subtractor 312 for calculating a difference between a gray scale level shown as a reference signal Ref and a gray scale level of the pixel indicated by an image signal VID, an integrator 314 for integrating the result of the subtraction output to one row of pixel located at the selected scanning line, and an adder 322 that provides the integration Int multiplied by the coefficient k1 as the corrected image signal.

10 Claims, 14 Drawing Sheets

IMAGE SIGNAL CORRECTING CIRCUIT, IMAGE PROCESSING METHOD, ELECTRO-OPTICAL DEVICE AND ELECTRONIC APPARATUS

BACKGROUND OF THE INVENTION

1. Field of Invention

The present invention relates to an image signal correcting circuit, an image signal correcting method of an electro-optical device, an electro-optical device, and an electronic apparatus applying the electro-optical device to a display unit, the electro-optical device preventing the degradation of display quality caused by so-called "horizontal crosstalk."

2. Description of Related Art

For a display panel that performs display by means of an optical change of an electro-optical material such as a liquid crystal, a given liquid crystal is interposed between a pair of substrates. The display panel can be classified into several categories, one of which is an active matrix type that drives a pixel electrode by three-terminal type switching device, for example. The active matrix type has a general configuration as follows. In other words, of a pair of substrate constituting this type of display panel, a plurality of scanning lines and a plurality of data lines are arranged to intersect each other on one substrate, and a pixel electrode and a three-terminal type switching device such as a thin film transistor are also arranged to correspond to each of the above intersecting portions, and peripheral circuits are arranged to drive each of the plurality of scanning lines and the plurality of drive lines around the area (display area) where the pixel electrodes are arranged. Further, on the other substrate, a transparent electrode (common electrode) facing the pixel electrode is arranged to maintain a constant potential. Here, on each facing surface of both substrates, a rubbing processed alignment film is arranged such that a long axis direction of the liquid crystal molecular consecutively is tilted, for example, about 90 degrees between both substrates, while a polarizer is arranged on each of opposition side of both substrates, according to the direction of alignment.

Here, a switching element respectively arranged at the intersecting portion between the scanning line and the data line is turned on when a scanning signal applied to the scanning line becomes active, to apply an image signal sampled in the data line to the pixel electrode. For this reason, to a liquid crystal capacitor consisting of the liquid crystal interposed between the pixel electrode and the counter electrode, a voltage that is the difference between potentials for the pixel electrode and counter electrode is applied. And then, even when the switching device is turned off, the applied voltage is maintained in the liquid crystal capacitance, due to its own capacitance or cumulative capacitance.

At this time, light passing between the pixel electrode and the counter electrode refracts about 90 degrees along with the tilt of the liquid crystal when an effective voltage between both electrodes is 0, while as the given effective voltage grows larger, the liquid crystal molecule is tilted toward the electric field so that its optical activity is lost. For this reason, in the transmission type, for example, when the polarizer whose polarizing axis is perpendicular to each other to match the alignment direction is arranged at each incident side and the bottom side (in a normally white mode), the light is transmitted for 0 effective voltage between both electrodes to perform a white display (large transmittance), while as the effective voltage grows larger, the light is blocked to perform a black display (small transmittance). Therefore, by controlling the voltage applied to the pixel electrode for each pixel, a predetermined display is enabled.

However, in the display panel, there is a problem in that a so-called horizontal crosstalk can be generated to lead to degradation of a display quality. Here, a term 'horizontal crosstalk' refers to a case where a right (horizontal scanning direction) gray region becomes brighter (or darker) than an original gray and comes back to its original gray color when displaying a window with a black region of a rectangular shape in a gray background, as shown in FIG. 14 for the normally white mode. Further, in FIG. 14, a gray scale level is shown using a line density of a slant line.

This type of horizontal crosstalk can be addressed by a technology that adds a potential change of the counter electrode to the image signal supplied to the pixel electrode.

However, although the above type of horizontal crosstalk can be suppressed to some extent, other type of horizontal crosstalk can be generated. This type of horizontal crosstalk refers to a case where when displaying a black region window in a gray background, an area, which is within the background gray region, becomes brighter that it contacts with an adjacent region in right or left direction of the corresponding black region and is one-row away from the corresponding black area toward the vertical scanning direction, as shown in FIG. 15.

Accordingly, the present invention is designed to solve the above-mentioned problems, it is an object of the present invention to provide an image signal correcting circuit and an image signal correcting method for an electro-optical device, an electro-optical device and an electronic apparatus to which this electro-optical device is applied in the display unit, in which a new type of horizontal crosstalk is suppressed to enable a high quality display.

SUMMARY OF THE INVENTION

To achieve the above object, there is provided an image signal correcting circuit of an electro-optical device of the present invention which corrects and supplies an image signal to a display panel comprising a plurality of scanning lines; a plurality of data lines; a plurality of switching elements arranged correspondingly to intersections of the plurality of scanning lines and the plurality of data lines and interposed between each data line and each pixel electrode corresponding to each switching element, wherein the switching element is turned on when the scanning line is selected; and counter electrodes facing the pixel electrodes, with an electro-optical material therebetweeen, wherein after precharging each data line to a predetermined voltage, the image signal is applied to pixel electrodes located at a selected scanning line through a corresponding data line, the circuit comprising: a subtractor for calculating the difference between a reference gray scale level and a gray scale level of a pixel indicated by an image signal; an integrator for integrating the result obtained by the subtractor to pixels corresponding to one row of a selected scanning line; and an adder for adding the result obtained by the integrator to each of image signals applied to pixels corresponding to one row of a subsequently selected scanning line to output the sum as a corrected image signal. When the precharge period is not given enough, the precharge will not fully done, causing the precharge voltage applied to each data line to be different. As such, although the image signals have the same voltage, when the image signals in the previous row are different, the precharge voltage in the following row becomes different, leading to a different voltage applied to the pixel electrode in practice.

According to the present invention, it is possible to correct a voltage applied to the pixel electrode even if the precharge voltage is different, by calculating one row of accumulation in difference with the reference gray scale level and adding the accumulation to the image signal of the following row as a correction value.

Here, preferably, the reference gray scale level of the present invention is a gray color in a pixel. The degradation of the display quality is ready to occur in the gray display region in which a change ratio of the gray scale level is large with respect to the effective voltage, so that by selecting the gray as a reference gray scale level, a comparison effect will be greater.

Further, the effect caused by the difference of the precharge voltage is gradually changed from one side to the other side in the direction of the scanning line, so that it is desirable in the present invention to further comprise a circuit to gradually reduce or increase an integration output of the integrator, based on the case where a pixel located at the selected scanning line is scanned horizontally from one side to the other side. With this configuration, to multiply a coefficient that varies with a constant ratio from one side to the other side, with the integration output can be devised.

Further, this concept can also be applied to an image signal processing circuit as well as an image signal processing method of an electro-optical device, and further to an electro-optical device itself. Moreover, since an electronic apparatus of the present invention comprises the electro-optical device as a display unit, a generation of crosstalk is suppressed.

DETAILED DESCRIPTION OF PREFERRED EMBODIMENTS

Before proceeding to an image signal correcting circuit according to an embodiment of the present invention, an electro-optical device to which the image signal correcting circuit is applied will be described. This is because the image signal correcting circuit is closely related to the driving of the electro-optical device so that it is difficult to explain the image signal correcting circuit without understanding the driving of the electro-optical device.

Figure 1:
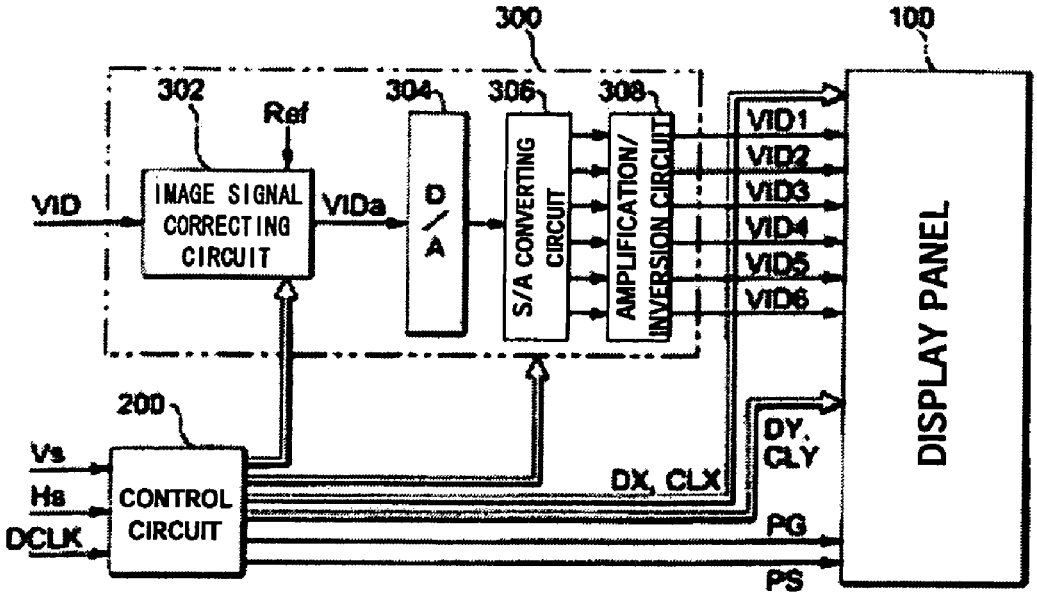
FIG. 1 is a block diagram showing an overall structure of a liquid crystal display device according to an embodiment of the present invention.

The electro-optical device performs a predetermined display using a liquid crystal as an electro-optical material. FIG. 1 is a block diagram showing an overall configuration of the electro-optical device. As shown in FIG. 1, the electro-optical device includes a display panel 100, a control circuit 200 and an image signal processing circuit 300. Among these, the control circuit 200 generates a timing signal or a clock signal and the like to control each unit, based on a vertical scanning signal Vs, a horizontal scanning signal Hs and a dot clock signal DCLK, supplied from the above device which is not shown herein.

Further, the image signal processing circuit 300 comprises an image signal correcting circuit 302, a D/A converter 304, an S/P converting circuit 306 and an amplification/inverting circuit 308.

Among these, the image signal correcting circuit 302 corrects a digital image signal VID supplied in synchronization with the vertical scanning signal Vs, the horizontal scanning signal Hs and the dot clock signal DCLK (i.e., based on the vertical scanning and the horizontal scanning) to convert it as an image signal VIDa, as described below. Here, a detailed description with respect to the image signal correcting circuit 302 will be described below in detail.

The D/A converter 304 converts the corrected image signal VIDa into an analog image signal. Further, when the analog image signal is input, the S/P converting circuit 306 divides the analog signal into N (N=6 in FIG. 1) system, and expands this N times in time axis (serial-parallel conversion) to output. Here, the reason why the image signal is serial-parallel converted is that, for a sampling switch 151 (refer to FIG. 3) described below, a sample and hold time and a charge and discharge time should be ensured because the time to apply the image signal is somewhat long. The amplification/inverting circuit 308 inverts a signal that needs a polar inversion among the serial-parallel converted image signals, and then, amplifies the inverted signal appropriately to provide the amplified signal to the display panel 100 as image signals VID1 to VID6. Here, the polar inversion is an aspect (1) for each scanning line, (2) for each data signal line, (3) for each pixel, but an embodiment of the present invention will be described herein with reference to the polar inversion (1) for each scanning line. However, it should not be understood that this intends to restrict the scope of the present invention. Further, the polar inversion according to an embodiment of the present invention refers to an alternative inversion of the voltage level as a reference to the predetermined constant voltage Vc (amplitude centered potential of the image signal, which is approximately same as LCcom, the applied voltage of the counter electrode). Here, to write the voltage higher than the voltage Vc into the pixel electrode is called as "positive write", while to write the voltage lower than the voltage Vc into the pixel electrode is called as "negative write".

Further, in this embodiment, although the image signal VIDa corrected by the image signal correcting circuit 302 is analog-converted, it may be also analog-converted after serial-parallel conversion or the amplification/conversion. Moreover, the supply timing to the display panel 100 of the converted image signals VID1 to VID6 is at the same time according to the embodiment of the present invention, however, it can also be shifted one after another in synchronization with a dot clock to sample a N-system image signal one after another in the following sampling circuit.

Figure 2:
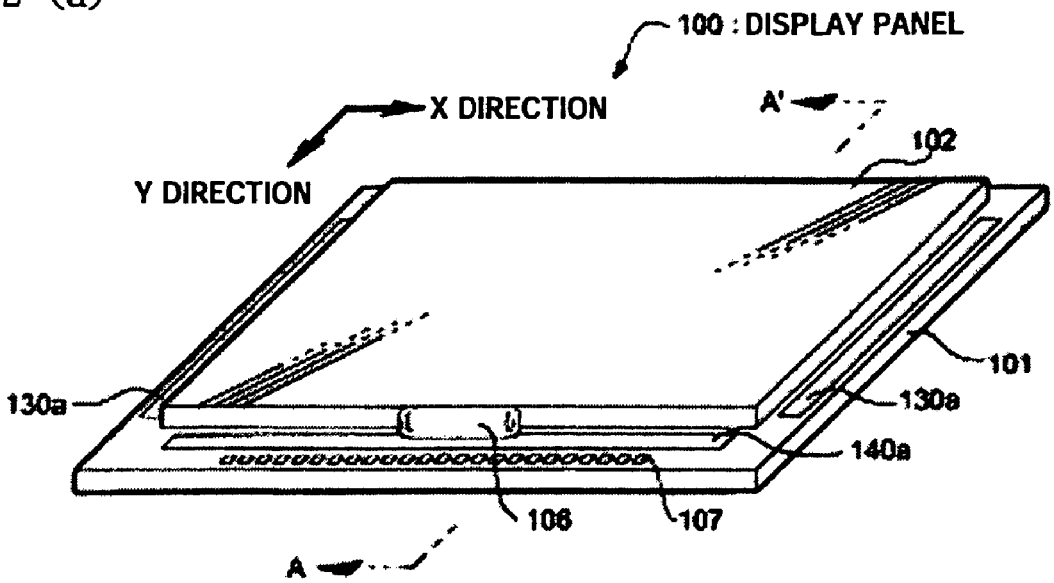
FIG. 2(*a*) is a perspective view showing a structure of a display panel of the liquid crystal display device and FIG. 2(*b*) is a cross-sectional view taken along the line A-A' of FIG. 2(*a*).
Figure 2:
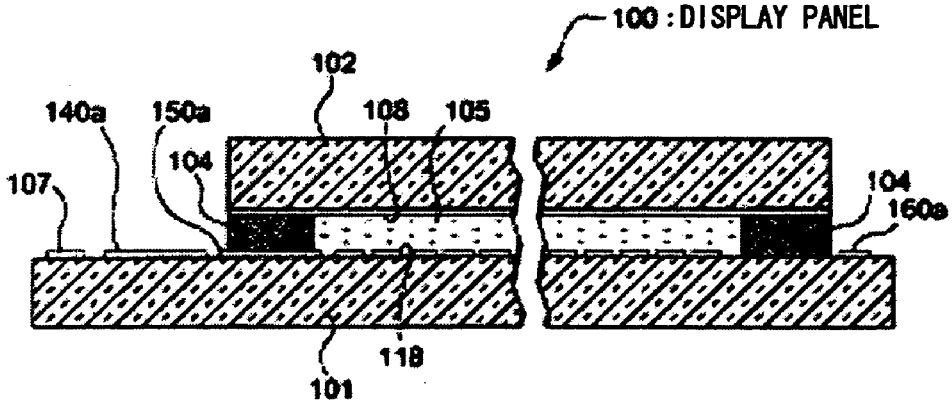

Next, the structure for the display panel 100 is described below. FIG. 2(*a*) is a perspective view showing a structure of the display panel 100, and FIG. 2(*b*) is a sectional view taken along the line A-A' of FIG. 2(*a*).

As shown in FIGS. 2(*a*) and 2(*b*), the display panel 100 comprises an element substrate 101 on which various elements and pixel electrodes 118 are formed, and a counter substrate 102 on which counter electrodes 108 are formed, wherein a constant gap is maintained by a sealant 104 comprising a spacer (not shown) arranged such that electrode forming planes face each other, and a twisted nematic (TN) liquid crystal 105, for example, is sealed in the gap. Further, although a glass, a semiconductor and quartz are used for the element substrate 101 in an embodiment of the present invention, an opaque substrate may also be used. However, when the opaque substrate is used for the element substrate 101, it requires a reflection type rather than a transmission type. Further, although the sealant 104 is formed along the peripheral of the counter substrate 102, some of which has an opening portion formed therein to seal the liquid crystal 105. For this reason, after sealing the liquid crystal 105, the opening portion thereof is sealed with a sealing material 106.

Next, contacting with the counter plane of the element substrate 101, a data line driving circuit 140 is formed in an outer side area 140*a* of the sealant 104, and further, a sampling circuit 150 is formed in the inner area 150*a*. However, in the outer circumferential portion, a plurality of mounting terminals 107 is formed to receive various signals from the control circuit 200 or the processing circuit 400. Further, in the two side areas 130*a* adjacent to the one side, the scanning line driving circuit 130 is formed, respectively, to drive the scanning line from both ends. When the delay of the scanning signal supplied from the scanning line does not matter, the scanning line driving circuit 130 can also be formed as many as one at one side. Moreover, in the area of the remaining side 160*a*, a common wiring line (not shown) used in two scanning line driving circuits 130 or a precharge circuit 160 described below is formed.

On the other hand, the counter electrode 108 arranged on the counter substrate 102 has a configuration such that it is electrically connected to the mounting terminal 107 formed on the element substrate 101, through a conducting material such as silver paste arranged in at lest one corner among four corners in the contact area with the element substrate 101, and thus a constant voltage LCcom is applied.

Further, on the counter substrate 102, although not specifically shown, a colored layer (color filter) is arranged, if necessary, in the area facing the pixel electrode 118. However, when it is applied to a color light modulation as in a projector described below, the colored layer is not necessary to be formed in the counter substrate 102.

Further, regardless of whether the colored layer is arranged or not, in order to prevent a contrast ratio from being degraded by light leakage, a light shielding film is formed on a portion other than the area opposite to the pixel electrode 118 (not shown).

Further, a rubbing-processed alignment film is arranged on the counter surface of the element substrate 101 and the counter substrate 102 such that the long axis direction of the molecule elliptical for the liquid crystal 105 is tilted by about 90 degrees consecutively between both substrates, while a polarizer corresponding to the alignment direction is provided on each back surface side. However, it will be not shown because this is not closely related to the present invention. Also in the FIG. 2(*b*), it is shown that the counter electrode 108, the pixel electrode 118, and the mounting terminal 107 have each thickness, but it is drawn exaggeratedly for convenience in order to represent a positional relationship, and in reality, the thickness of the substrate is very thin to be negligible.

Figure 3:
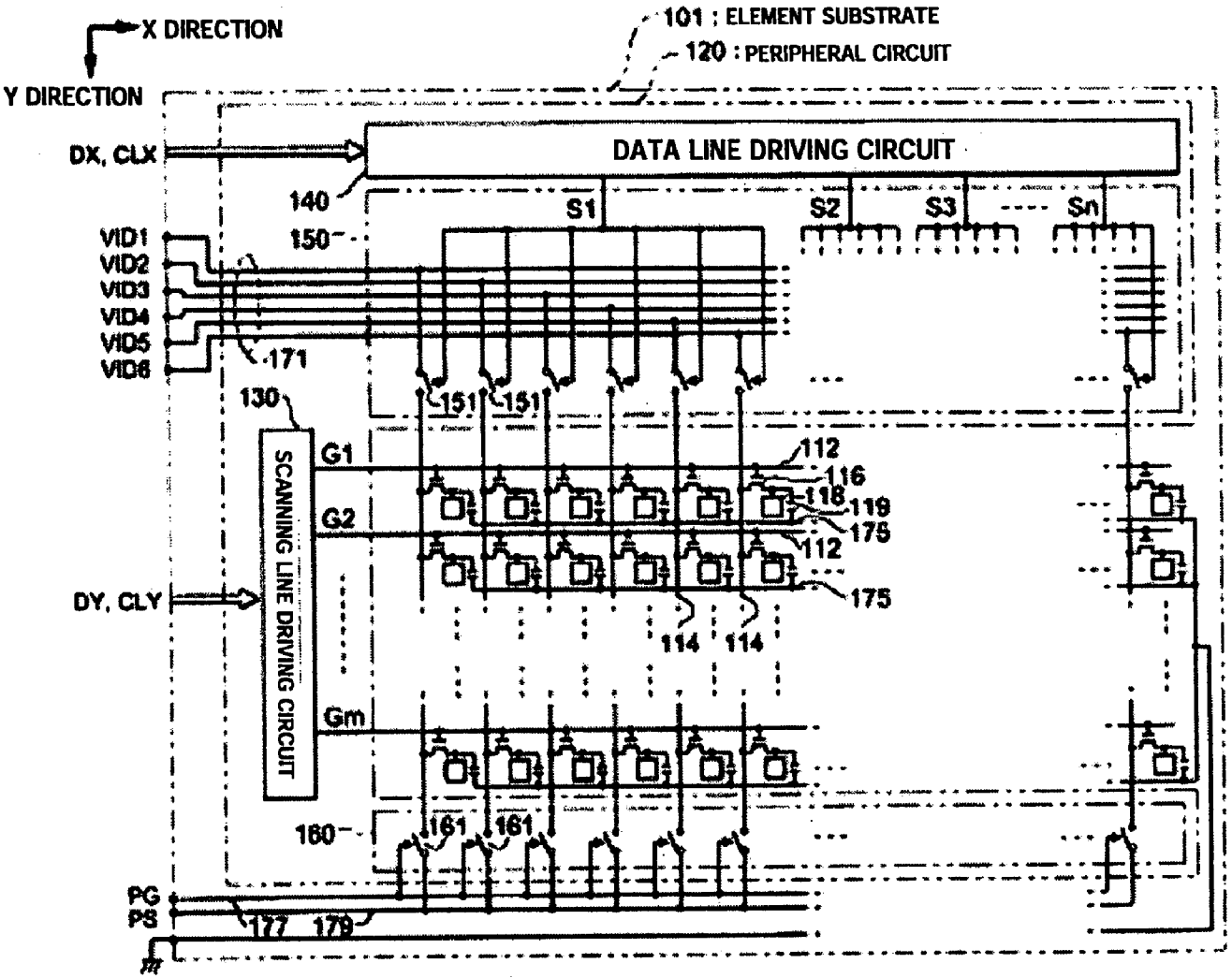
FIG. 3 is a block diagram showing an electrical structure of an element substrate for the display panel.

Next, an electrical arrangement of the element substrate 101 in the display panel 100 will now be described. FIG. 3 is a block diagram showing a structure of the element substrate 101.

As shown in FIG. 3, in the display region of the element substrate 101, a plurality of scanning lines 112 is formed in parallel along a row (X) direction, and a plurality of data lines 114 is formed in parallel along a column (Y) direction. In addition, in the portion at which each scanning line 112 and each data line 114 cross each other, a gate of a thin film transistor (hereinafter, referred to as a "TFT") 116 serving as a switching element for controlling the pixel is connected to the scanning line 112, while a source of the TFT 116 is connected to the data line 114, and at the same time, a drain of the TFT 116 is connected to a transparent rectangular pixel electrode 118.

As described above, in the display panel 100, a liquid crystal 105 is disposed between an electrode forming surface of an element substrate 101 and an electrode forming surface of the counter substrate 102, so that a capacitance of the liquid crystal for each pixel comprises the pixel electrode 118, the counter electrode 108, and the liquid crystal 105 interposed therebetween. Here, for convenience, assuming that a total number of the scanning lines 112 is 'm' and a total number of the data lines 114 is '6n' (where m and n is an integer, respectively), each pixel corresponds to each crossing portion between the scanning line 112 and the data line 114, thereby being arranged in a matrix of m×6n.

Further, in the display region comprising pixels in a matrix, a storage capacitor 119 is formed in every pixel to prevent the liquid crystal capacitor from leaking. One end of the storage capacitor 119 is connected to the pixel electrode 118 (drain of the TFT 116), while the other end thereof is commonly connected to the capacitor line 175. Further, the capacitor line 175 maintains the constant voltage (for example, voltage LCcom, higher power supply voltage and lower power supply voltage of the driving circuit, and the like) through the mounting terminal 107, according to an embodiment of the present invention.

On the other hand, a peripheral circuit 120 is formed on the non-display region of the element substrate 101. The peripheral circuit 120 comprises a test circuit for determining whether there is a defect after fabrication, as well as a scanning line driving circuit 130, a data line driving circuit 140, a sampling circuit 150, and a precharge circuit 160.

However, the detailed description of the test circuit will be omitted herein because it is not closely related to the present invention.

In addition, the constituent elements of the peripheral circuit 120 are formed with the common fabrication process that is the same as that of the TFT 116 driving the pixel. As such, the peripheral circuit 120 is built in the element substrate 101, and when the constituent elements are formed with the common process, it is advantageous to achieve a low cost or small size of the overall device, compared with the type that the peripheral circuit 120 is formed on additional substrate and is externally attached.

Figure 4:
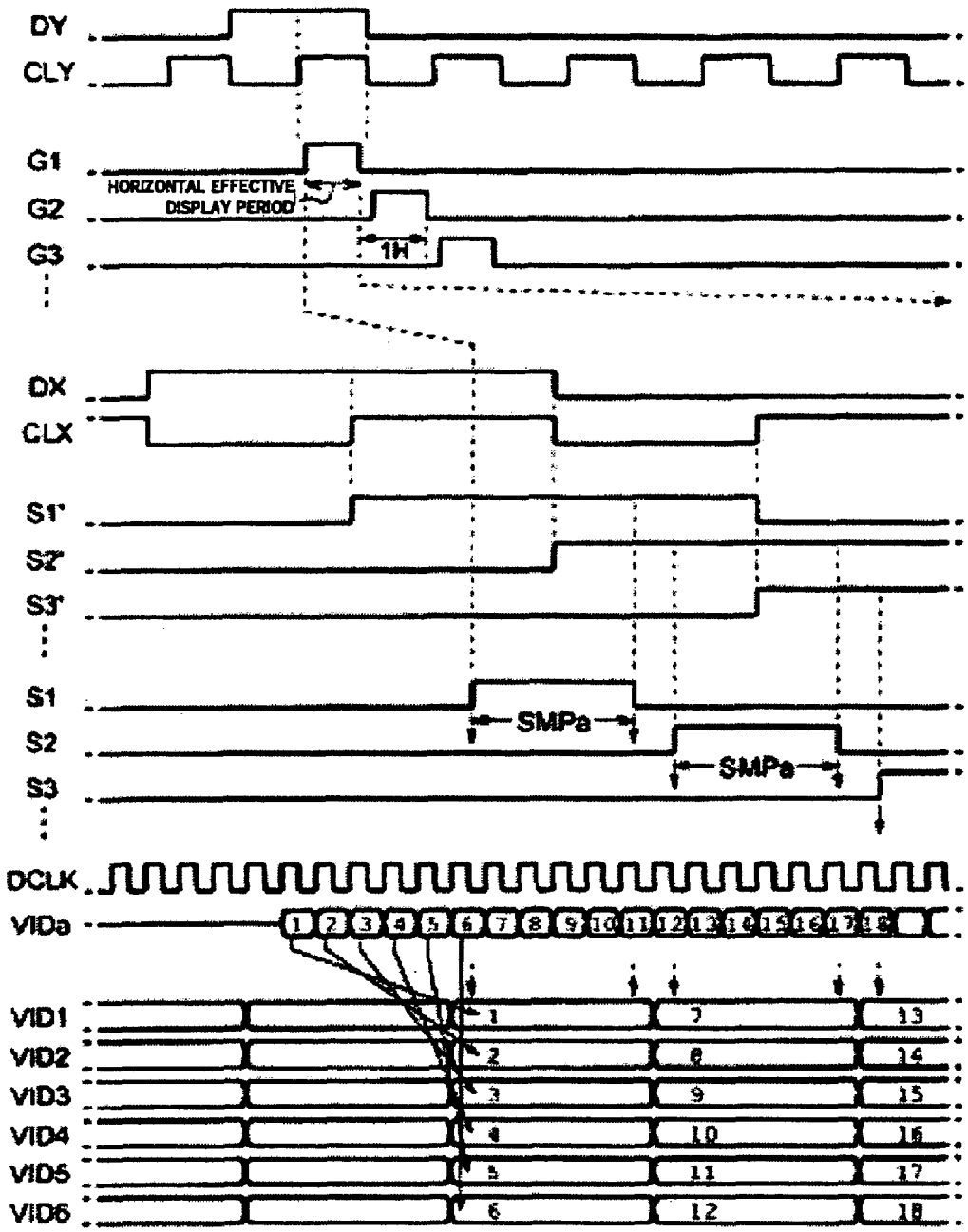
FIG. 4 is a timing chart for illustrating an operation of the liquid crystal display device.

In addition, the scanning line driving circuit 130 in the peripheral circuit 120 outputs scanning signals G1, G2, . . . , and Gm, which become active only for one horizontal effective display period, for one vertical effective display period, in order in every one horizontal scanning period (1H), as shown in FIG. 4. Since the scanning line driving circuit 130 is also not closely related to the present invention, it is not shown in the drawing, however, it should be noted that the scanning line driving circuit 130 sequentially shifts a transmission start pulse DY supplied first in the one vertical scanning period to generate the scanning signals G1, G2, . . . , and Gm whenever a clock signal CLY transits the level.

Further, the data line driving circuit 140 outputs sampling signals S1, S2, . . . , and Sn, which become active one after another, for one horizontal effective display period. Since the data line driving circuit 140 is also not closely related to the present invention, it is not shown in the drawing, however, it should be noted that the data line driving circuit 140 comprises a shift register and a plurality of logical AND circuits, wherein the shift register shifts one after another the transmission start pulse DX supplied first in the one horizontal effective display period to output as signals S1', S2', S3', . . . and Sn' whenever the clock signal CLX transits the level, as shown in FIG. 4, and wherein each of the logical AND circuits make a pulse width of the signals S1', S2', S3', . . . and Sn' narrow to the-period SMPa so that each adjacent pulse does not overlap to output as sampling signals S1, S2, S3, . . . , and Sn.

The sampling circuit 150 samples image signals VID1 to VID6 provided through six image signal lines 171 into each data line 114 based on the sampling signals S1, S2, S3, . . . , and Sn, comprising sampling switches 151 provided in every data line 114.

Here, a block is made for every six data lines 114, and a sampling switch 151 connected to one end of the leftmost data line 114 among six data lines 114 belonging to an ith (i is 1, 2, . . . , and n) block counted from the left in FIG. 3 samples the image signal VID1 provided through the image signal line 171 for a period that the sampling signal Si becomes active, to provide the sampled image signal to the corresponding data line 114. In addition, the sampling switch 151 connected to one end of the second data lines 114 among the six data lines 114 belonging to the same ith block samples the image signal VID2 for a period that the sampling signal Si becomes active, to provide the sampled image signal to the corresponding data line 114. Similarly, each of the sampling switches 151 connected to one end of each of 3rd, 4th, 5th and 6th data lines 114 among the six data lines 114 belonging to the ith block samples the image signals VID3, VID4, VID5 and VID6, respectively, for a period that the sampling signal Si becomes active, to provide the sampled image signals to the respective corresponding data lines 114.

Further, the TFT constituting the sampling switch 151 is a N channel type in the embodiment of the present invention, so that when the sampling signals S1, S2, . . . , and Sn become H level, the corresponding sampling switch 151 is turned on. In addition, the TFT constituting the sampling switch 151 can be either P channel type or a complementary type that is a combination of both channels.

On the other hand, in the display region, there is a precharge circuit 160 on the area opposite to the data line driving circuit 140. The precharge circuit 160 comprises precharge switches 161 provided in every data line 114, and each precharge switch 161 precharges the precharge voltage PS supplied through a precharge signal line 179 into the data line 114, when the precharge control signal PG supplied through a precharge control line 177 becomes active.

Figure 5:
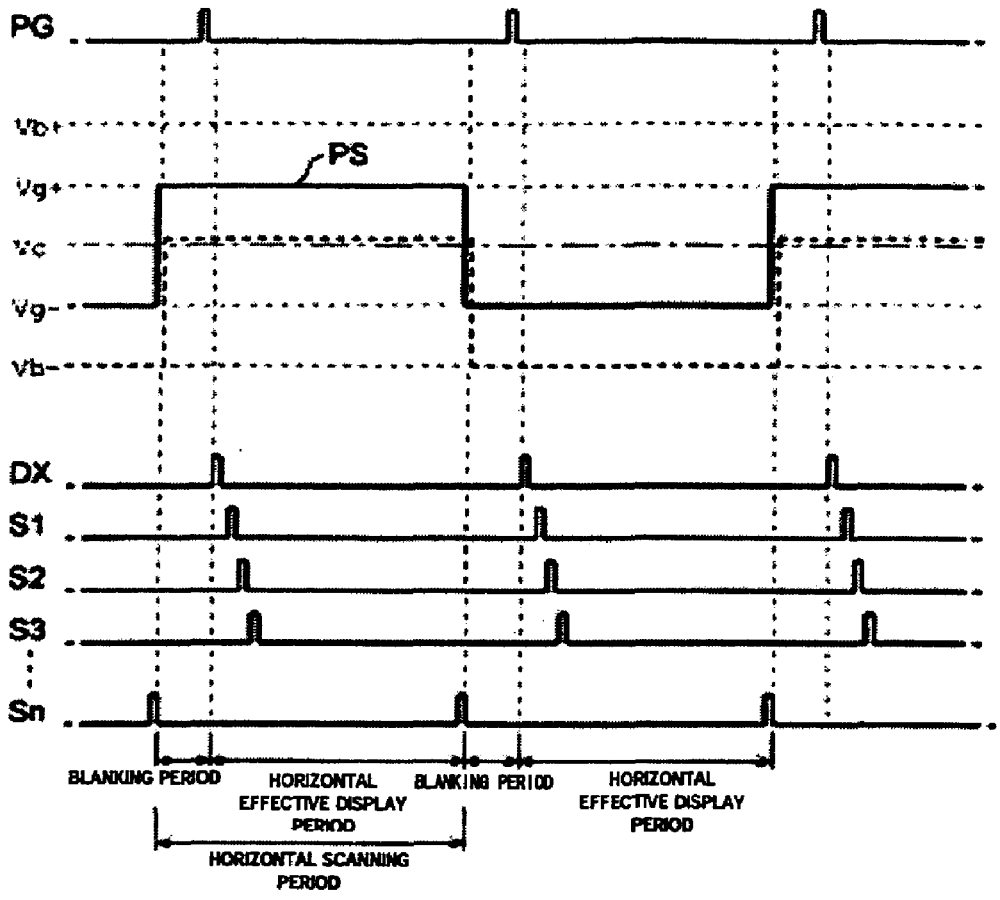
FIG. 5 is a timing chart for illustrating an operation of the liquid crystal display device.

As shown in FIG. 5, the precharge control signal PG is one that becomes active for a period isolated from the temporal adjacent time among a blanking period except for the period from one horizontal scanning period to one horizontal effective display period. Further, the precharge voltage PS is a level inverting signal from a voltage Vg+ to a voltage Vg− with reference to a voltage Vc, for example, for each half period of a clock signal CLY (one horizontal scanning period) as shown in FIG. 5, and when a positive write is made in the horizontal effective display period, the voltage Vg+ is taken for a blanking period, and when a negative write is made in the horizontal effective display period, the voltage Vg− is taken for a blanking period.

Here, as described above, the voltage Vc is a potential for amplitude center of the image signals VID1 to VID6, and has the same potential as a voltage LCcom applied to the counter electrode 108. Further, the voltage Vg+ and the voltage Vg− are higher and lower than the voltage Vc, respectively, both corresponding to gray color. In addition, the precharge voltage PS is not limited to the voltage corresponding to the gray color.

Further, a voltage Vb+ and a voltage Vb− are voltages for displaying black in the positive write and the negative write, respectively, when the present embodiment performs a white display in normally-white mode without applying voltage.

With the precharge circuit 160 having the above-mentioned structure, for the blanking period just prior to the horizontal effective display period in which the sampling signals S1, S2, S3, . . . , and Sn are provided, each data line 114 is precharged to the voltage Vg+ and the voltage Vg− in advance, so that for the immediately next horizontal effective display period, a load will be reduced when the image signals VID1 to VID6 are sampled in the data line 114.

Further, although one scanning line driving circuit 130 is arranged at only one side of the scanning line 112 in FIG. 3, this is, however, just for illustration of the electrical arrangement. In practice, as shown in FIG. 2, two scan line driving circuits 130 are arranged at both ends of the scanning line 112.

Next, operation of an electro-optical device will be described with reference to the case where the image signal VID is not corrected by the image signal correcting circuit 302, but is directly supplied to the D/A converter 304.

First, the transmission start pulse DY is initially supplied to the scanning line driving circuit 130 for one vertical scanning period. Through this, the scanning signals G1, G2, G3, . . . , and Gm become active one after another, exclusively with each other to be output to each scanning line 112, as shown in FIG. 4.

Here, one horizontal effective display period for which the scanning signal G1 becomes active will be first described. Further, assuming that this one horizontal effective display period is for positive writing, for convenience, the image signals VID1 to VID6 output from the S/P converting circuit 306 (see FIG. 1) become higher than the voltage LCcom (strictly speaking, the voltage Vc) applied to the counter electrode 108, as it becomes a black color, the voltage is increased.

On the other hand, for the blanking period prior to the horizontal display period, the precharge control signal PG becomes active in an isolated period from after and before that period, as shown in FIG. 5. At this time, the precharge voltage PS becomes the voltage Vg+ corresponding to the positive write. For this reason, during the corresponding period, all of the data lines 114 are precharged to the voltage Vg+.

Next, at the end of the blanking period, when the scanning signal GI becomes active in the horizontal effective display period, the transmission start pulse DX is first supplied to the data line driving circuit 140, as shown in FIG. 4 or FIG. 5. As a result, the sampling signals S1, S2, S3, . . . , and Sn are output one after another, which could be made narrow to the period SMPa such that the adjacent signal pulse widths does not overlap.

When not corrected by the image signal correcting circuit 302, the image signal VID is firstly converted into the analog signal by the D/A converting circuit 304, and secondly, is distributed into the image signals VID1 to VID6 by the S/P converting circuit 306, and at the same time, is extended six times in time dimension, and thirdly, is appropriately amplified and inverted by the amplifying/inverting circuit 308 to be supplied to the display panel 100.

For a period that the scanning signal G1 becomes active, when the sampling signal S1 becomes active, each of the image signals VID1 to VID6 are sampled into the six data lines 114 belonging to the first block from the left. In addition, the sampled image signals VID1 to VID6 are applied to each corresponding pixel electrode 118, by means of the TFT 116 of the pixel intersecting the first scanning line 112 counted from the above line in FIG. 3 and the corresponding six data lines 114.

Next, when the sampling signal S2 becomes active, each of the image signals VID1 to VID6 are sampled into the six data lines 114 belonging to the second block, and the sampled image signals VID1 to VID6 are applied to each corresponding pixel electrode 118, by means of the TFT 116 of the pixel intersecting the first scanning line 112 and the corresponding six data lines 114.

Similarly, when the sampling signals S3, S4, . . . , and Sn become active one after another, each of the image signals VID1 to VID6 are sampled into the six data lines 114 belonging to the 3rd, 4th, . . . , and nth blocks, and the sampled image signals VID1 to VID6 are applied to each corresponding pixel electrode 118, by means of the TFT 116 of the pixel intersecting the first scanning line 112 and the corresponding six data lines 114. In this manner, all of the write operations to the pixels in the first row are completed.

Continuously, a period that the scanning signal G2 becomes active will be described. In this embodiment, a polar inversion is made in every scanning line as described above, so that for the one horizontal scanning period, a negative writing is performed. For this reason, the image signals VID1 to VID6 output from the S/P converting circuit 306 is lower than the voltage LCcom applied to the counter electrode 108, and as proceeded to the black color, its voltage is lowered. Prior to this, the precharge voltage PS for the blanking period becomes the voltage Vg− corresponding to the negative write, so that when the precharge control signal PG becomes active, all of the data lines 114 are precharged to the voltage Vg−.

As in other operations, the sampling signals S1, S2, S3, . . . , and Sn become active one after another, so that all of the write operations for the second row pixels are completed. Similarly, the scanning signals G3, G4, . . . , and Gm become active, and the write operations for the pixels in the 3rd, 4th, . . . , and mth rows are performed. In this manner, the pixels in the odd rows undergo the positive write, while the pixels in the even rows undergo the negative write, so that for the one vertical scanning period, the write operations for all of pixels in the first to mth rows are completed.

Further, in the next one vertical scanning period, the same write operation is performed, but the write polarity for pixels of each row can be changed at this time. In other words, for the next one vertical scanning period, the pixels in the odd rows undergo the negative write, while the pixels in the even rows undergo the positive write. As such, the write polarity for pixels can be alternated by each one vertical scanning period, so that DC component is not applied to the liquid crystal 105, thereby preventing the liquid crystal 105 from being degraded.

Figure 15:
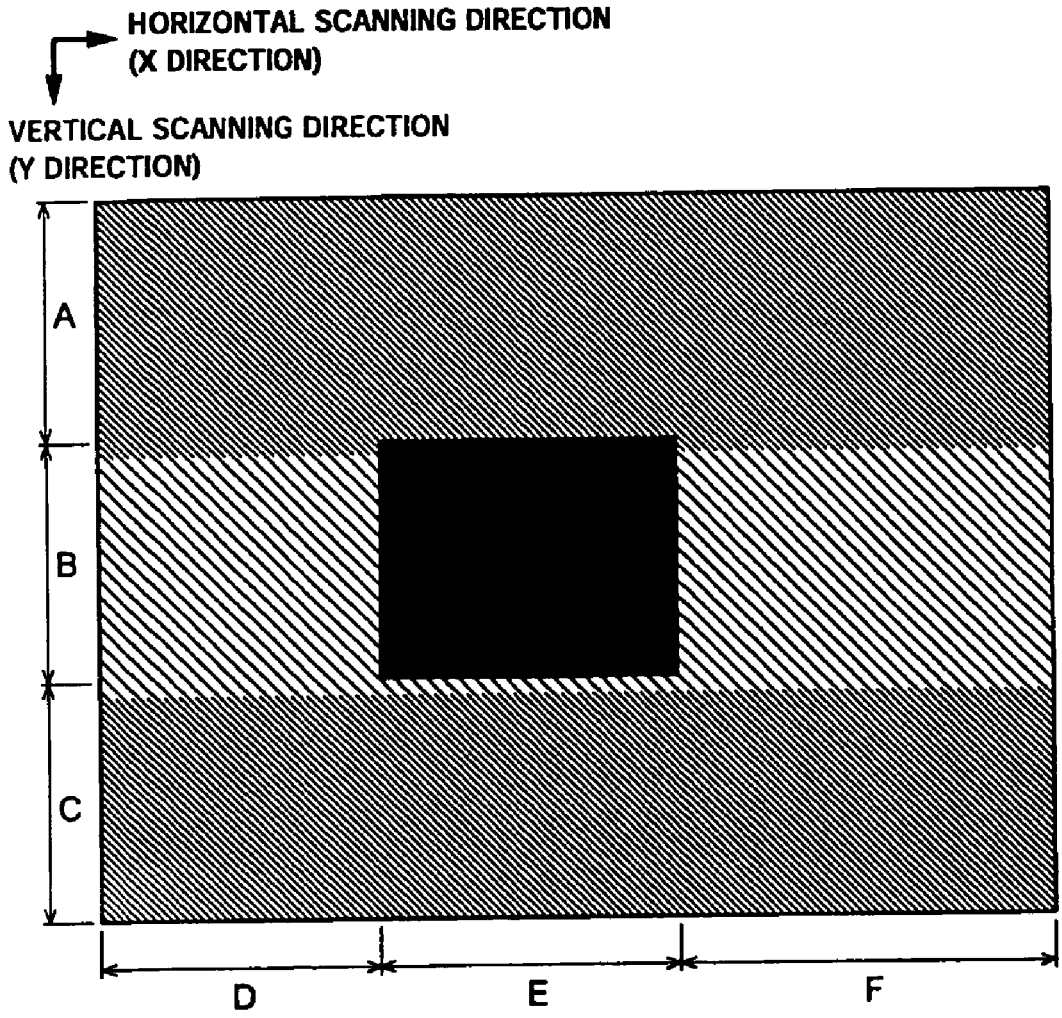
FIG. 15 is a plan view showing a degradation of display quality caused by horizontal crosstalk.

However, when the black window is displayed with a gray background in the display panel 100, the above-mentioned horizontal crosstalk is generated as shown in FIG. 15. Here, regarding the fact that the gray region that gets brighter is shifted one row to the black region, it can be appreciated that the write-in operation to the gray region that gets brighter is affected by the write-in operation to the rows with black region. For this reason, the inventors substantially conclude that the horizontal crosstalk described above to be a subject of the present invention is caused by the shortage in write operation of the precharge voltage performed in the blanking period, from the relationship of a degree of a lightness difference generated by displaying various patterns.

Here, the shortage in write operation of the precharge voltage according to the above conclusion will now be described. In FIG. 15, when the scanning line 112 belonging to A area or C area is selected (when only the gray region not including the black region is horizontally scanned), the image signals VIDi (one of VID1 to VID6) supplied to any one of the image signal line 171 becomes one of the voltage Vg+ and the voltage Vg− that corresponds to the gray color throughout the one horizontal effective display period, as shown in FIG. 6(*a*). For the one horizontal effective display period that performs a positive write, for example, this indicates that the voltage Vg+ is sampled to all of the data lines 114 by turning the corresponding sampling switch 151 on. Further, since there is more or less parasitic capacitance in the data line 114, even when the corresponding sampling switch 151 is turned off, it remains Vg+, a voltage of the sampling image signal at the time of turning on. In other words, immediately prior to the precharge operation, all of data lines 114 become the voltage Vg+.

After the positive write operation, the negative write operation is followed, but right before that, the precharge operation is also performed as described above. For this reason, for immediately before the negative write operation, all data lines 114 are precharged from a voltage Vg+ to Vg− that is a voltage corresponding to the negative write operation.

Figures 6A, 6B:
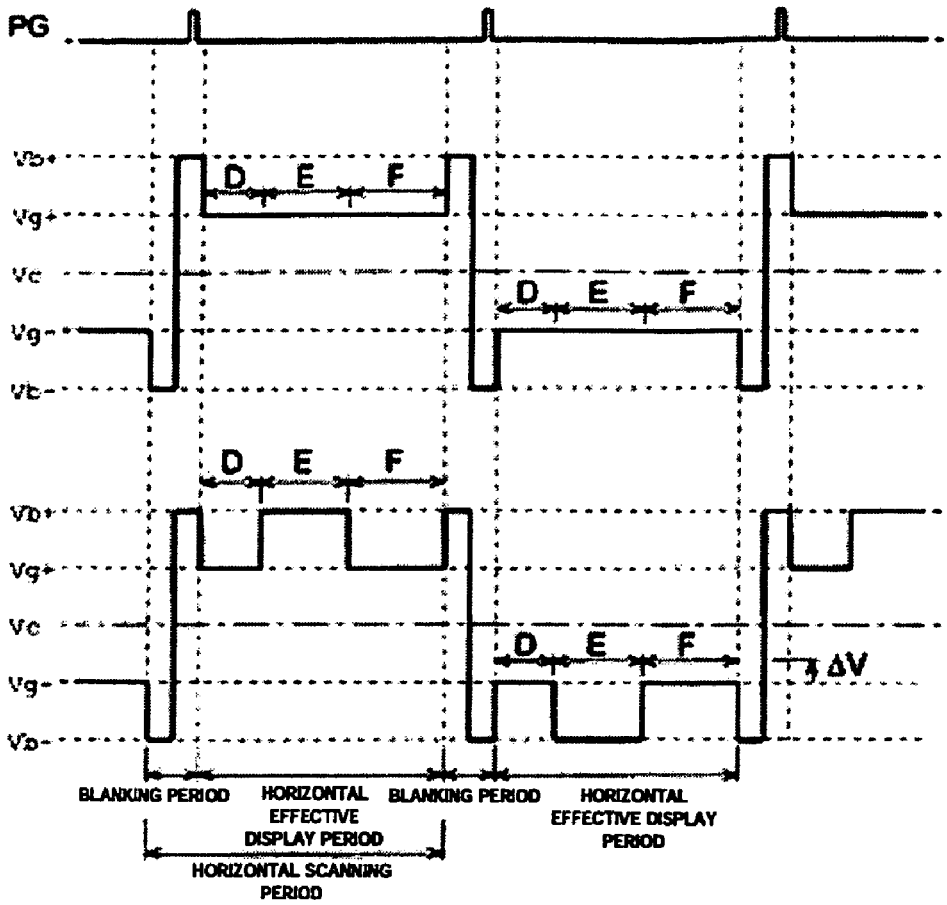
FIG. 6 is a block diagram illustrating prevention of display quality degradation by the liquid crystal display device.

Meanwhile, when the scanning line 112 belonging to the B area in FIG. 15 is selected (when a region with the black region is horizontally scanned), the image signal VIDi supplied to one of the image signal lines 171 becomes a voltage Vg+ (or Vg−) corresponding to the gray color when the data line 114 belonging to the D region or F region is horizontally scanned, as shown in FIG. 6*b*, while it becomes a voltage Vb+ (or Vb−) corresponding to the black color when the data line 114 belonging to an E region is horizontally scanned. This indicates that for the one horizontal effective display period that performs the positive write operation, the data line 114 belonging to the D region or F region is sampled to a voltage Vg+, and the data line 114 belonging to the E region is sampled to a voltage Vb+, so that even when the sampling switch 151 is turned off, the data lines keep the sampled voltage. In other words, for immediately before the precharge, the data line 114 belonging to the D region or F region becomes a voltage Vg+, while the data line 114 belonging to the E region becomes a voltage Vb+, which is higher than the voltage Vg+.

For this reason, in order to precharge all of the data lines 114 to a voltage Vg−, it is necessary that the case right after the scanning line 112 belonging to the B region is selected is compared with the case right after the scanning line 112 belonging to the A region or C region is selected, so that the larger the amount of charge and discharge is, the longer time is required.

Recently, since the display panel has increasingly many pixels to require a high speed driving, it is somewhat difficult to have enough time to precharge, and therefore, regarding the voltage actually precharged in the data line 114, the case right after the scanning line 112 belonging to a B region is selected is higher as much as ΔV than the case right after the scanning line 112 belonging to an A region or a C region is selected, as shown in FIG. 6*b* (a precharge for right after the positive write operation and right before the negative write operation).

For right before the negative write operation, between the case where the data line 114 is a voltage Vb− and the case the data line is higher as much as ΔV than the above one, the latter will be higher in the final voltage to be applied to the pixel electrode 118 even though a voltage Vg− of the same gray color is sampled to the data line 114. For this reason, the latter has a smaller value in the effective voltage of the liquid crystal capacitor. In other words, the effective voltage value of the liquid crystal capacitor applied for the horizontal scanning period subsequent to the horizontal scanning period selecting the scanning line 112 belonging to a B region, becomes smaller than the effective voltage value of the liquid crystal capacitor applied for the horizontal scanning period subsequent to the horizontal scanning period selecting the scanning line 112 belonging to the A region or C region, even when it is the same gray color, and when in the normally white mode, it becomes brighter, which is acknowledged as a brightness difference.

Further, for right after the negative write operation and right before the positive write operation, the change direction of the voltage is reversed, but with regard to the effective voltage, a degree of reduction is not changed. Also, for the black region other than the gray region, it can be understood that the effective voltage is reduced due to the same reason, but in the black region, the brightness difference is hardly acknowledged. This is because, for the liquid crystal device, a characteristic (V-T characteristic) of transmittance to the effective voltage is rather dull around the white color or black color than around gray color, so that though there is a little difference in the effective voltage, it is hardly acknowledged as a brightness difference.

Here, when the horizontal crosstalk is caused by the shortage of a precharge write operation, it may be also brought up as a measure not to perform such precharge operation at all. However, in the display panels of nowadays, there are a plenty of pixels, so that there is not enough time to write in the pixel electrode. For this reason, when the data line 114 is not precharged, the image signal cannot be sampled to the data line 114 in a short time, and further, when the image signal is written to the pixel electrode through the data line, with a difference of voltage remaining in the data line, display quality is further degraded than caused by the horizontal crosstalk. Therefore, it cannot be easily employed as a measure not to perform the precharge operation.

As such, the effective voltage written to the liquid crystal capacitor by being horizontally scanned for any one horizontal scanning period varies depending on the voltage precharged to the data line 114 for right before that period, and the voltage precharged to all of the data lines 114 depends on the gray scale level of one row of pixels horizontally scanned for right before that period. Conversely speaking, this means that the gray scale level of one row of pixels horizontally scanned for any one horizontal scanning period changes the effective voltage of one row of pixels horizontally scanned for the following one horizontal scanning period.

Therefore, the voltage determined from the gray scale level of pixels in the immediately preceding one row overlaps to the image signal supplied when the one row of pixels are horizontally scanned for any one horizontal scanning period, in advance in the opposite direction to cancel the change, in anticipation with the write shortage of the precharge voltage, so that it can be appreciated that the actual effective voltage can be applied to the liquid crystal capacitor. The arrangement taking this into account is an image signal correcting circuit 302. The image signal correcting circuit 302 will now be described.

Figure 7:
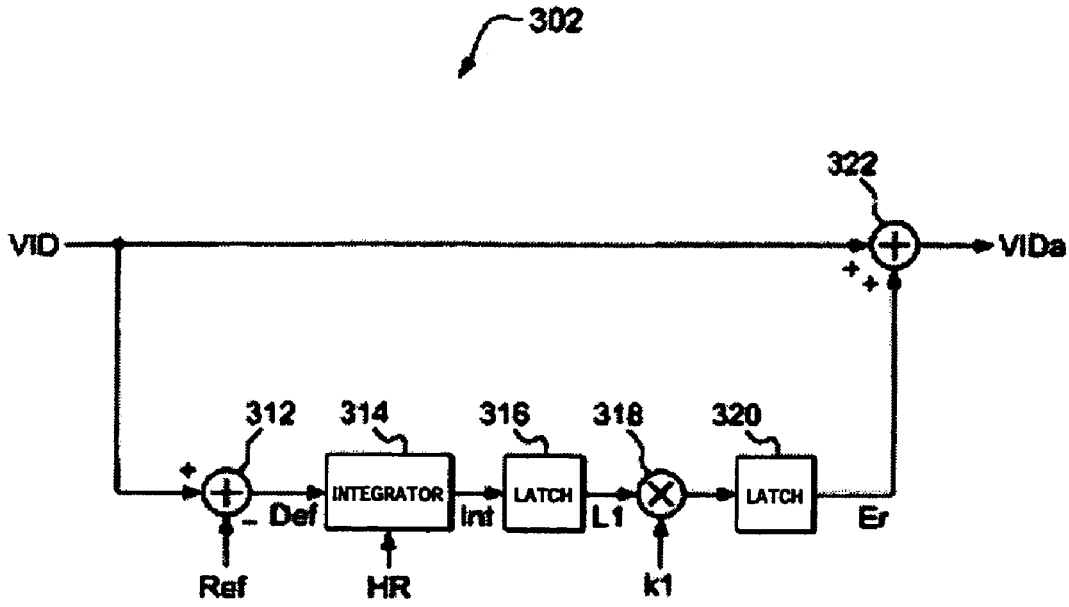
FIG. 7 is a block diagram illustrating a structure of a correcting circuit in the liquid crystal display device.

FIG. 7 is a block diagram showing a structure of the image signal correcting circuit 302.

In FIG. 7, a subtractor 312 subtracts a reference signal Ref from the digital image signal VID, and outputs the subtracted result Def. As described above, the change amount of the precharge voltage is determined by the gray scale level of one row of pixels that is horizontally scanned right before, but in order to specify the change of the gray scale level, it is necessary to determine the reference of the gray scale level in advance. The reference signal Ref is used to determine the reference of the gray scale level.

An integrator 314 is supplied with a signal HR that becomes high level only in the horizontal effective display period, and resets the integration result by the rising of the signal HR, and then, integrates the subtraction result Def only for the period that the signal HR is in H level to output the integration result Int.

A latch circuit 316 latches the integration result Int at the timing that the image signal VID corresponding to the pixels in the last nth column outputs, to output as a signal L1. A multiplier 318 multiplies the signal L1 by a coefficient k1. The latch circuit 320 latches the multiplication result of the multiplier 318, and retains it as the corrected data Er for the next horizontal effective display period. An adder 322 adds the corrected data Er to the image signal VID to output it as the corrected image signal VIDa.

Figure 8:
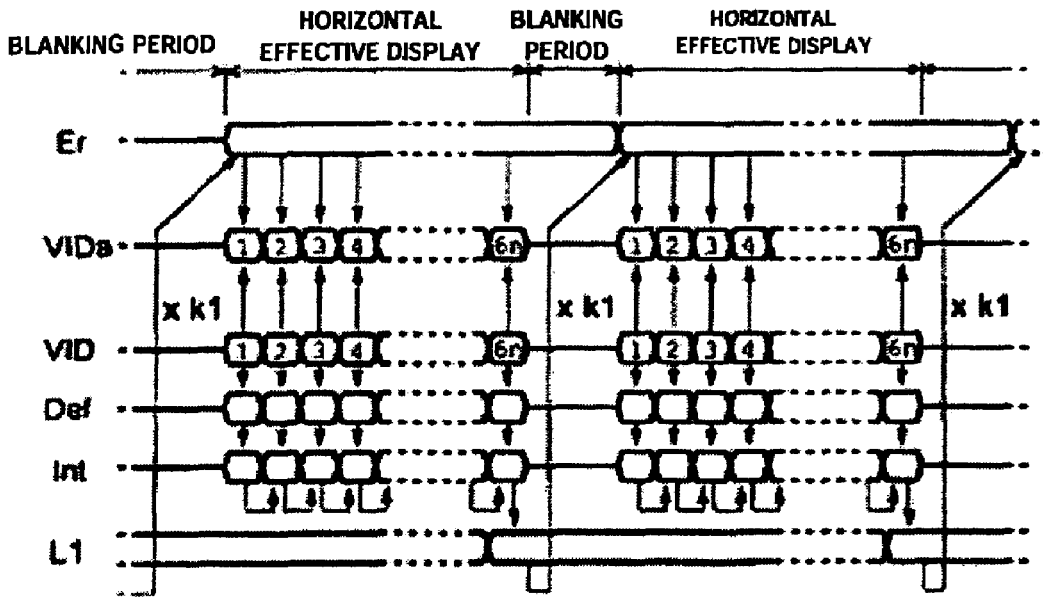
FIG. 8 is a timing chart for illustrating an operation of the correcting circuit.

Operation of the image signal correcting circuit 302 is described with reference to a timing chart of FIG. 8. First, for one horizontal effective display period, the digital image signal VID is supplied according to the horizontal scanning. Here, the corrected data Er that can be found in the preceding one horizontal effective display period is respectively added to the image signal VID of one row of pixels horizontally scanned in any one horizontal effective display period to output it as the corrected image signal VIDa.

Meanwhile, referring to the calculation of the corrected data Er that can be found in any one horizontal effective display period, the subtraction result Def between the image data VID and the reference signal Ref is calculated in one row for each pixel by the subtractor 312, and the integration result Int of the subtraction result Def is then integrated by the integrator 314. For this reason, the signal L1 latched by the latch circuit 316 is a value that accumulates the subtraction result Def that represents a difference between the gray scale level reference of the reference signal Ref and the gray scale level of pixels to be horizontally scanned in the corresponding one horizontal effective display period, by one row of the pixels. The corrected data Er is obtained by multiplying this signal L1 by the coefficient k1, and the corrected data Er is also added to each of image signals VID in one row of pixels horizontally scanned in the following one horizontal effective display period, and is then supplied to the D/A converter 304 as the corrected image signal VIDa.

Therefore, the corrected data Er determined by the gray scale level of the immediately preceding one row pixels is added in advance to the image signal VID of one row of pixels horizontally scanned in any one horizontal scanning period as a component to cancel the change, in anticipation with the shortage of a precharge voltage, so that the actual effective voltage is applied to the liquid crystal capacitor.

For example, in FIG. 15, when the scanning line 112 belonging to an A region or a C region is selected, the horizontally scanned pixels are all gray, while when the scanning line 112 belonging to a B region is selected, the horizontally scanned pixels are added, the gray color in a D region or an F region is added to black color in an E region, so that the latter will be larger for the integration result Int that accumulates in one row the difference of the reference gray scale level that indicates the reference signal Ref. The integration result Int multiplied by the coefficient k1 is added to the image data of one row of pixels horizontally scanned next, so that it gets brighter to correct the darkening direction, which cancels the horizontal crosstalk described above.

Figure 9:
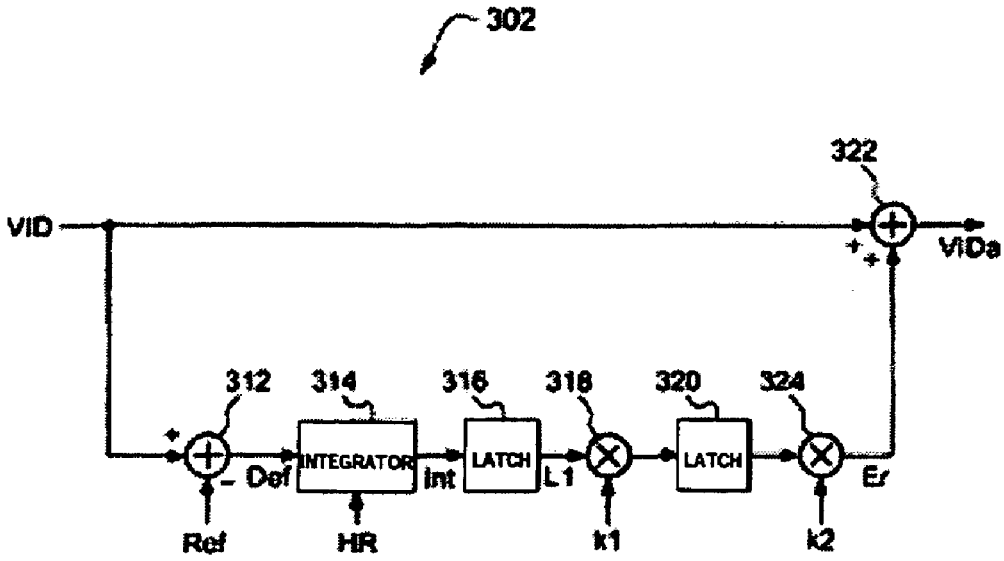
FIG. 9 is a block diagram showing an alternative structure of a correcting circuit.

Further, as in the embodiment of the present invention, for the horizontal effective display period in which any scanning line 112 is selected, when the image signals are sampled one after another for six data lines 114, a first part and a last part of the horizontal effective display period have a different elapse time from the end time of the precharge, so that the change of the precharge voltage can be derived from other factors. As shown in FIG. 9, there may be provided a multiplier 324 that multiplies the coefficient k2 by the corrected data Er between the latch circuit 320 and the adder 322. Here, the coefficient k2 is set to be linearly reduced, for example, from the start to the end of one horizontal effective display period, as shown in FIG. 10.

With this arrangement, the corrected value is increased at the start of one horizontal effective display period, and as the time elapses, the corresponding amount of correction is reduced, so that it is possible to consider an influence due to the different elapsed time from the precharge operation.

Figure 10:
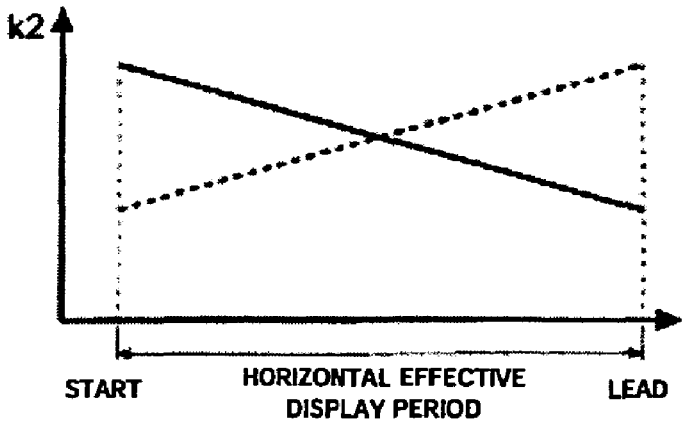
FIG. 10 is a diagram showing a coefficient of the correcting circuit of FIG. 9.

Further, for the coefficient k2, there may be increased with time, like a dotted line shown in FIG. 10, depending on whether it is in a normally white mode or not, or on which voltage corresponding to a gray scale level the precharge voltage is set to. Also, there may be a change like a quadratic curve as well as the liner change.

Further, although the present invention is described with the vertical scanning direction of G1→Gm, and the horizontal scanning direction of S1→Sn, for a rotatable display panel or a projector described below, it is necessary to invert the scanning direction. However, since the image signal VID is supplied in synchronization with the vertical scanning and the horizontal scanning, it does not need to change the overall image signal processing circuit 300 comprising the image signal correcting circuit 302.

Although the above-mentioned embodiment of the present invention has been described in connection with the case where the precharge voltage PS is precharged to the data line 114, by turning the precharge switch 161 on, a configuration can also be used that, for example, for a period that the precharge control signal PG is in H level, the precharge operation is performed by turning on the all of the sampling switches 151 as well as by applying the precharge voltage PS to the six image signal lines 171.

In the above-mentioned embodiment, with six data lines 114 as one block, the image signals VID1 to VID6 that are converted into 6-system type are sampled using six data lines 114 belonging to one block, but the number of conversion and the number of the data lines (i.e., the number of the data lines constituting one block) is not limited to '6'. For example, when response speed of the sampling switch 151 of the sampling circuit 150 is sufficiently high, the corrected image signals can be sampled one after another for each data line 114 by transmitting the corrected image signal in serial to one image signal line without converting the corrected image signal into parallel. Further, although the number of data lines simultaneously applied and the number of conversions is '3', '12', or '24', one corrected image signal can be provided at the same time using '3', '12' and '24' type conversions, for the 3, 12 and 24 data lines. Further, for the number of conversions, it is desirable to be multiples of 3 for simplicity of a control and a circuit since the color image signal is made of three primary colors. However, for the simple use of light conversion like a projector described below, it does not need to be multiples of 3.

On the other hand, although the digital image signal VID is processed with the image signal processing circuit 300 in the above embodiment of the present invention, an analog image signal can be also processed. With this configuration, the voltage of the image signal refers to a gray scale level of the pixel. Further, although the correction is made prior to serial-parallel conversion of the image signal in the image signal processing circuit 300 according to the embodiment of the present invention, the correction may be made after the serial-parallel conversion, and even without the aforementioned serial-parallel conversion.

Moreover, although a normally white mode is described that displays the white color when the effective voltage between the counter electrode 108 and the pixel electrode 118 is small, according to the embodiment of the present invention, it can be a normally black mode that displays the black color. Further, although a voltage Vg+ and a voltage Vg− corresponding to the gray color as the precharge voltage PS is selected to invert the level in every one horizontal scanning period based on the write polarity, it can be a voltage corresponding to white color, and as shown in a dotted line of FIG. 5, it can be a different voltage corresponding to the different gray scale level according to the write polarity, e.g., for a positive write operation, a voltage Vc corresponding to white color may be selected and for a negative write operation, a voltage Vb+ corresponding to black color may be selected. Further, for the case the precharge voltage PS selects the different gray scale level according to the write polarity, it is necessary to arrange a gray scale level that representing the reference signal Ref in response to the polarity.

Further, although the embodiment of the present invention uses a glass substrate in the element substrate 101, an SOI (silicon on insulator) technology can be used to form a silicon single crystal film on an insulation substrate such as sapphire, quartz and glass, and various devices can be formed thereon. Further, as the element substrate 101, the silicon substrate and the like can be used and various devices can be formed thereon. In this case, a field effect transistor can be used as one of various switches, so that a high-speed operation is facilitated. However, when the element substrate 101 is not transparent, a reflection type can be used such that the pixel electrode 118 is made of Al, or additional reflection layer is formed.

Moreover, although the above-mentioned embodiment of the present invention uses a TN type liquid crystal, there may be used a bi-stable type that has a memory capability such as a BTN (Bi-stable Twisted Nematic) type or a ferroelectric type, a polymer dispersion type or a GH (guest host) type that arranges a dye molecule in parallel with the liquid crystal molecule by dissolving the dye (guest) having anisotropy for a visible light absorption in a long axis direction and a short axis direction to the liquid (host) with the constant molecule arrangement.

Further, a vertical alignment (homeotropic alignment) can be used such that the liquid crystal molecule is arranged in the vertical direction toward both substrates when a voltage is not applied, while the liquid crystal molecule is arranged in the horizontal direction toward both substrates when a voltage is applied, and a horizontal alignment (homogeneous alignment) can be used such that the liquid crystal molecule is arranged in the horizontal direction toward both substrates when a voltage is not applied, while the liquid crystal molecule is arranged in the vertical direction toward both substrates when a voltage is applied. As such, in the present invention, there can be used a variety of liquid crystals and alignment methods thereof.

<Electronic Apparatus>

Next, several electronic apparatuses using the electro-optical device according to the above-mentioned embodiment of the present invention are described.

<First Example of Electronic Apparatus: Projector>

Figure 11:
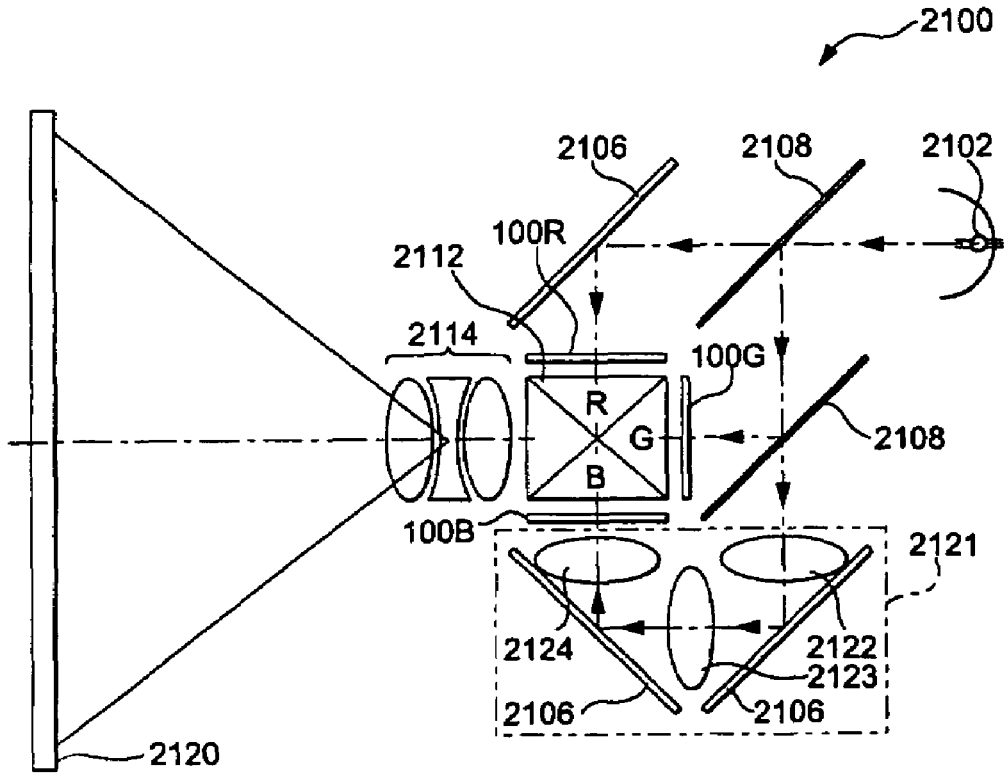
FIG. 11 is a cross-sectional view showing a structure of a projector as an example of an electronic apparatus to which a liquid crystal display device according to an embodiment of the present invention is applied.

First, a projector that uses the above-mentioned display panel 100 as a light valve is now described. FIG. 11 is a plan view showing a configuration of the projector. As shown in FIG. 11, a lamp unit 2102 comprising a white color light source such as a halogen lamp is provided in the projector 2100. A transmission light component emitted from the lamp unit 2102 is dividend into R (red), G (green) and B (blue), which are three primary colors, by three mirrors 2106 and two dichroic mirrors 2108, and is derived into light valves 100R, 100G and 100B corresponding to each primary color. Further, comparing B color light with other R color light or G color light, since the B color light has a long optical path, it is derived through a relay lens system 2121 comprising an incident lens 2122, a relay lens 2123 and an emitting lens 2124 to prevent its loss.

Here, the light valves 100R, 100*g* and 100B have the same configuration as that for the display panel 100 in the above-mentioned embodiment of the present invention, and each of them is driven by the image signals corresponding to each R, G and B color supplied from a processing circuit (not shown in FIG. 11). In other words, in the projector 2100, three display panels 100 shown in FIG. 1 is arranged to correspond to each R, G and B.

Further, each modulated light by the light valves 100R, 100G and 100B is incident in three directions into the dichroic prism 2112. In addition, R colored light and B colored light are refracted at 90 degrees at this dichroic prism 2112, while G colored light is straightly transmitted. Therefore, after each colored image is combined, a color image is transmitted in a screen 2120 through a transmission lens 2114.

Further, since the light corresponding to each primary color of R, G and B is incident into the light valves 100R, 100G and 100B by means of the dichroic mirror 2108, it is not necessary to arrange the color filter as described above. Further, the transmission image of the light valves 100R and 100B is transmitted after it is reflected by the dichroic mirror 2112, and the transmission image of the light valve 100G is directly transmitted, so that the horizontal scanning direction by the light valves 100R and 100B is in the direction opposite to the horizontal scanning direction by the light valve 100G to invert the image from right side to the left side.

<Second Example of Electronic Apparatus: Mobile Computer>

Figure 12:
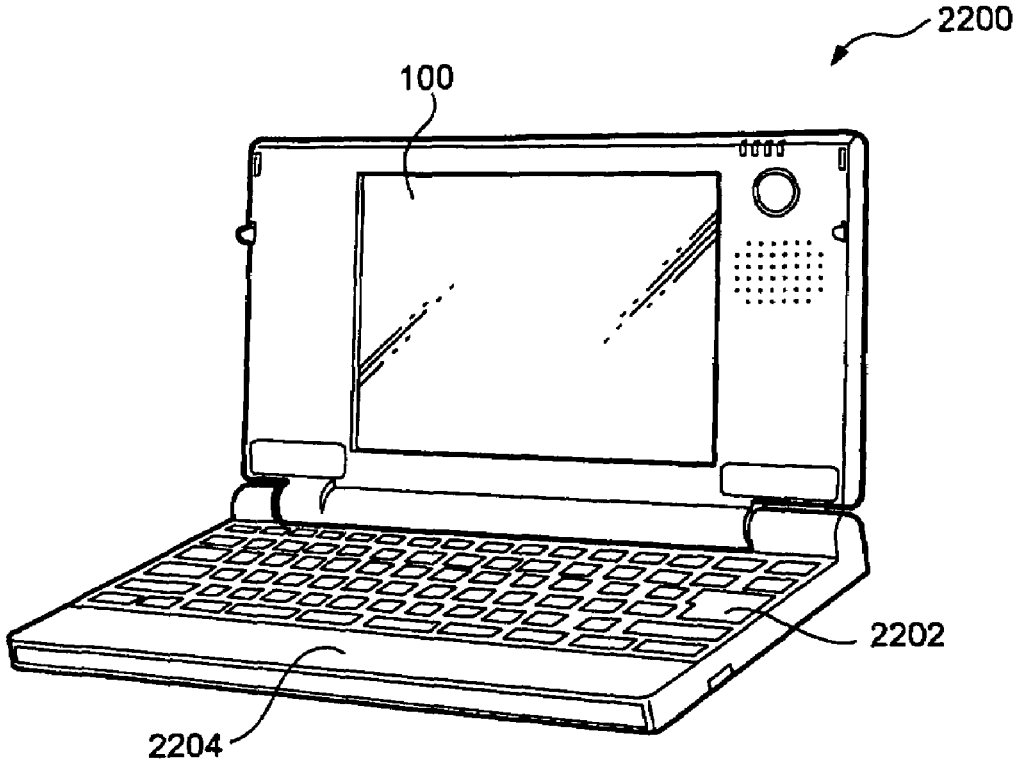
FIG. 12 is a cross-sectional view showing a structure of a personal computer as an example of an electronic apparatus to which the liquid crystal display device according to an embodiment of the present invention is applied.

Next, an example that the above-mentioned liquid crystal display device is applied to a mobile-type personal computer is illustrated. FIG. 12 is a perspective view showing a configuration of the personal computer. In FIG. 12, a computer 2200 comprises a main unit 2204 having a keyboard 2202, and a display panel 100 for use in a display unit. Further, in the rear side of the display panel 100, a backlight unit is provided (not shown) to increase visibility.

<Third Example of Electronic Apparatus: Mobile Phone>

Further, an example that the above-mentioned liquid crystal display device is applied to the display unit of the mobile phone is illustrated.

Figure 13:
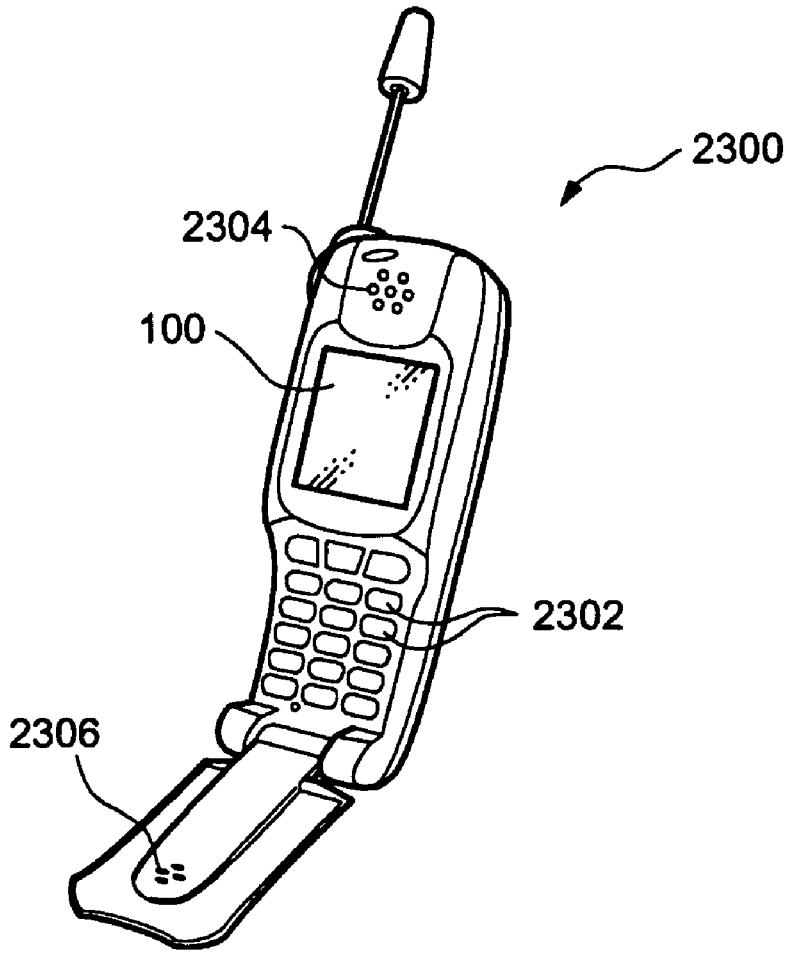
FIG. 13 is a perspective view showing a structure of a mobile phone as an example of an electronic apparatus to which the liquid crystal display device according to an embodiment of the present invention is applied.
Figure 14:
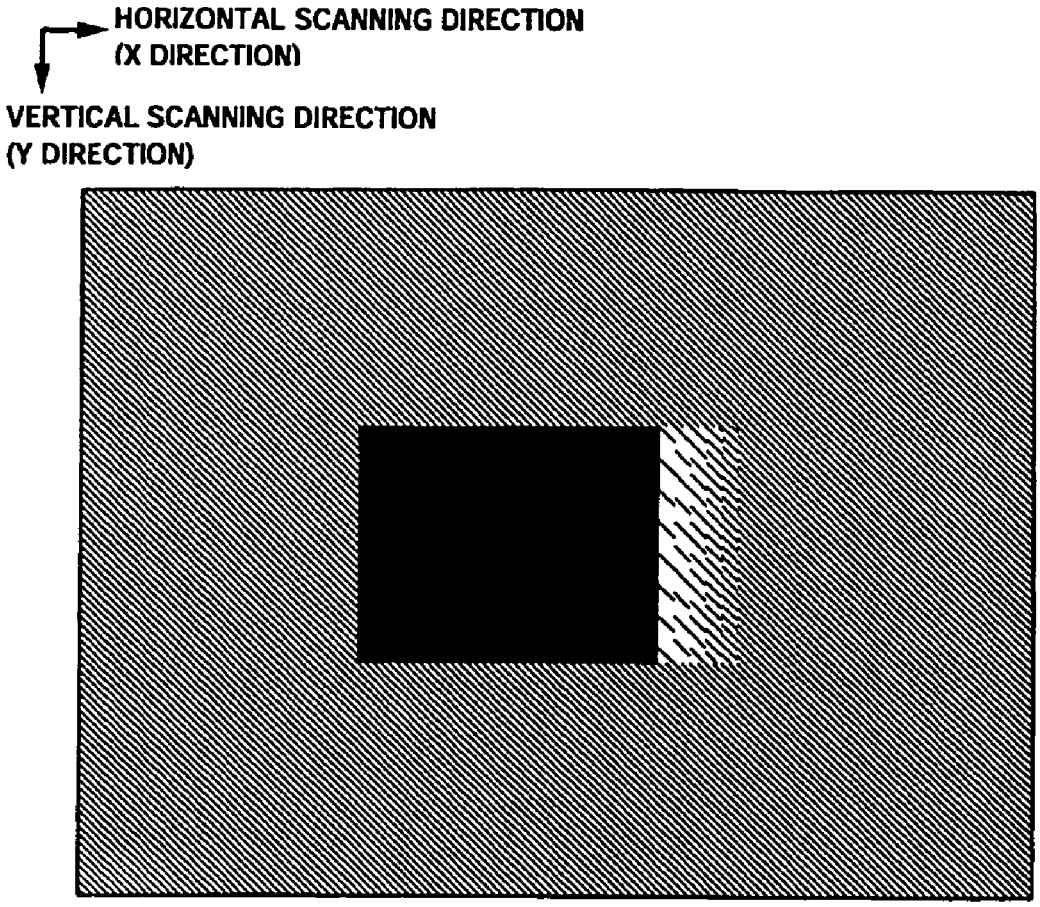
FIG. 14 is a plan view showing a degradation of display quality caused by horizontal crosstalk.

FIG. 13 is a perspective view showing a configuration of the mobile phone. In FIG. 13, a mobile phone 2300 comprises a plurality of control buttons 2302, an earpiece 2304, a mouthpiece 2306, and a display panel 100 for use in the display unit. Also, in the rear side of the display panel 100, a backlight unit (not shown) is also provided to increase visibility.

<Statistic in Electronic Apparatus>

Further, as the electronic apparatuses, in addition to some examples described with reference to FIG. 11 to 13, there can be employed a television, a view-finder-type and monitor-direct-view-type video tape recorder, a car navigation device, a pager, an electronic note, a calculator, a word processor, a workstation, a video phone, a POS terminal, a digital still camera, and a touch panel. In addition, it is needless to say that the electro-optical device according to the present invention can be applied to these various electronic apparatuses.

What is claimed is:

1. An image signal correcting circuit which corrects and supplies an image signal to a display which has a plurality of scanning lines; a plurality of data lines; a plurality of pixels arranged correspondingly to intersections of the plurality of scanning lines and the plurality of data lines; pixel electrodes constituting the pixels; and counter electrodes facing the pixel electrodes, with an electro-optical material therebetween, wherein the image signal is applied to a pixel electrode corresponding to a selected scanning line and a selected data line, the image signal correcting circuit comprising:

a subtractor for calculating the difference between a reference gray scale level and a gray scale level of a displayed pixel according to an image signal;

an integrator which integrates the result obtained by the subtractor with respect to pixels corresponding to a selected scanning line; and an adder which adds the result obtained by the integrator to each of image signals applied to pixels corresponding to a subsequently selected scanning line; and outputs the sum of the result obtained by the integrator and the image signals as corrected image signals.

2. The image signal correcting circuit according to claim 1, wherein the reference gray scale level corresponds to a gray display.

3. The image signal correcting circuit according to claim 1, further comprising:

a circuit for gradually reducing or increasing the result obtained by the integrator, along with horizontal scanning of pixels located at a subsequently selected scanning line from one end to the other end.

4. The image signal correcting circuit according to claim 1, the result obtained by the integrator is multiplied by the predetermined coefficient and supplied to the adder.

5. A method for correcting an image signal, in which after precharging each data line to a predetermined voltage, an image signal is corrected and supplied to a display panel that applies the image signal to pixel electrodes located at a selected scanning line through a corresponding data line, the display panel comprising a plurality of scanning lines; a plurality of data lines; a plurality of switching elements arranged correspondingly to intersections of the plurality of scanning lines and the plurality of data lines and interposed between each data line and each pixel electrode corresponding to each switching element, wherein the switching element is turned on when the scanning line is selected; and counter electrodes facing the pixel electrodes with an electro-optical material therebetween, the method comprising the steps of:

calculating, with a subtractor, the difference between a reference gray scale level and a gray scale level of a pixel indicated by an image signal;

integrating, with an integrator, the result obtained by the subtractor to pixels corresponding to one row of a selected scanning line; and adding the result obtained by the integrator to each of image signals applied to pixels corresponding to one row of a subsequently selected scanning line to output the sum as a corrected image signal.

6. An electro-optical device comprising;

a plurality of scanning lines;

a plurality of data lines;

a plurality of switching elements arranged correspondingly to intersections of the plurality of scanning lines and the plurality of data lines and interposed between each data line and each pixel electrode corresponding to each switching element, counter electrodes facing the pixel electrodes with an electro-optical material therebetween, and an image signal correcting circuit that supplies an image signal to the data lines, wherein the image signal correcting circuit comprises:

a subtractor which calculates the difference between a reference gray scale level and a gray scale level of a pixel indicated by an image signal; and an integrator which integrates the result obtained by the subtractor with respect to pixels corresponding to a selected scanning line; and an adder which adds the result obtained by the integrator to each of image signals applied to pixels corresponding to a subsequently selected scanning line ;and outputs the sum of the result obtained by the integrator and the image signals as corrected image signals, and the corrected image signals are supplied to the pixel electrodes located at a selected scanning line through a corresponding data line after precharging each data line to a predetermined voltage.

7. The electro-optical device according to claim 6, wherein the reference gray scale level corresponds to a gray display.

8. The electro-optical device according to claim 6, further comprising:

a circuit for gradually reducing or increasing the result obtained by the integrator, along with horizontal scanning of pixels located at a subsequently selected scanning line from one end to the other end.

9. The electro-optical device according to claim 6, the result obtained by the integrator is multiplied by the predetermined coefficient and supplied to the adder.

10. An electronic apparatus comprising the electro-optical device according to claim 6 as a display unit.

* * * * *